US008444513B2

(12) United States Patent
Cournoyer

(10) Patent No.: US 8,444,513 B2
(45) Date of Patent: May 21, 2013

(54) UNDERWATER FRISBEE GOLF DISC LOCATOR

(76) Inventor: Andre Mario Cournoyer, Virginia Beach, VA (US)

( * ) Notice: Subject to any disclaimer, the term of this patent is extended or adjusted under 35 U.S.C. 154(b) by 187 days.

(21) Appl. No.: 13/183,668

(22) Filed: Jul. 15, 2011

(65) Prior Publication Data

US 2012/0012494 A1 Jan. 19, 2012

Related U.S. Application Data

(60) Provisional application No. 61/364,534, filed on Jul. 15, 2010.

(51) Int. Cl.
*A63B 71/02* (2006.01)

(52) U.S. Cl.
USPC ..... 473/588; 206/315.1; 206/528

(58) Field of Classification Search
USPC 473/588, 589; 206/315.1, 528, 570; 446/153, 446/491; 273/148 R, 459
See application file for complete search history.

(56) References Cited

U.S. PATENT DOCUMENTS

| | | | | |
|---|---|---|---|---|
| 2,254,154 | A * | 8/1941 | Linney | 273/115 |
| 2,998,251 | A * | 8/1961 | McShane | 473/588 |
| 3,026,110 | A * | 3/1962 | Hess et al. | 473/570 |
| 3,812,614 | A * | 5/1974 | Harrington | 446/47 |
| 4,086,723 | A * | 5/1978 | Strawick | 446/47 |
| 4,254,575 | A * | 3/1981 | Gould | 446/46 |
| 4,431,196 | A * | 2/1984 | Kutnyak | 473/588 |
| 4,607,850 | A * | 8/1986 | O'Riley | 473/588 |
| 4,940,441 | A * | 7/1990 | Novinsky | 446/46 |
| 5,083,799 | A * | 1/1992 | Thill | 473/588 |
| 5,277,641 | A * | 1/1994 | Gable et al. | 446/46 |
| 5,326,110 | A * | 7/1994 | Gould | 473/588 |
| 5,853,311 | A * | 12/1998 | Bartholomew | 446/48 |
| 6,174,214 | B1 * | 1/2001 | Cooper | 446/46 |
| 7,413,083 | B2 * | 8/2008 | Belfance et al. | 206/540 |
| 2005/0150805 | A1 * | 7/2005 | Burchell | 206/534 |
| 2005/0263430 | A1 * | 12/2005 | Giovanni | 206/528 |
| 2006/0205544 | A1 * | 9/2006 | Wyner et al. | 473/569 |
| 2008/0000786 | A1 * | 1/2008 | Collotta et al. | 206/217 |
| 2008/0254705 | A1 * | 10/2008 | Mathis | 446/46 |
| 2010/0068966 | A1 * | 3/2010 | Wollner | 446/46 |

* cited by examiner

*Primary Examiner* — Raleigh W Chiu
(74) *Attorney, Agent, or Firm* — Sinorica, LLC

(57) ABSTRACT

A device for a Frisbee golf disc that indicate position when submerged underwater. The present invention is attached to the center of bottom of a Frisbee golf disc and comprises of a compartment with holes. The compartment holds an effervescent tablet that reacts with water to produce bubbles. The water is able to reach the effervescent tablet through the holes. The bubbles from the reaction of the effervescent tablet escape from the holes and rise to the surface of the water to indicate position for easy retrieval.

6 Claims, 3 Drawing Sheets

UNDERWATER FRISBEE GOLF DISC LOCATOR

The current application claims a priority to the U.S. Provisional Patent application Ser. No. 61/364,534 filed on Jul. 15, 2010.

FIELD OF THE INVENTION

The present invention relates generally to a device used to locate a frisbee golf disc underwater. More specifically, the present invention utilizes a device that is able to emit an indicator of the disc's position underwater.

BACKGROUND OF THE INVENTION

In the sport of disc golf, many courses have water hazards where a player can lose their discs. Many manufactured discs sink when it lands into the water. With the water depths of the waters ranging from 1 foot to 15 feet, many players are unable to recover their disc. In many cases, the discs that the players recover are not their own. Without being close to the water hazard to see the landing of the disc into the water, the players must also approximate the area the disc entered the water. As a result, finding the disc becomes a much more difficult task. The present invention introduces a device that can be attached to a Frisbee disc to overcome such a problem. The present invention allows a disc that has entered a water to indicate its position.

DETAIL DESCRIPTIONS OF THE INVENTION

All illustrations of the drawings are for the purpose of describing selected versions of the present invention and are not intended to limit the scope of the present invention.

Figure 1:
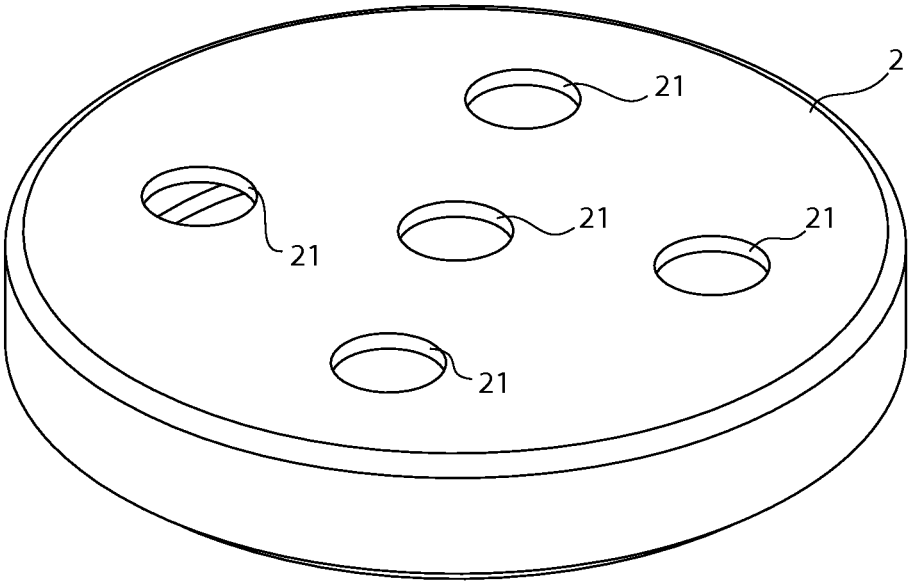
FIG. 1 is a perspective view of the present invention.
Figure 2:
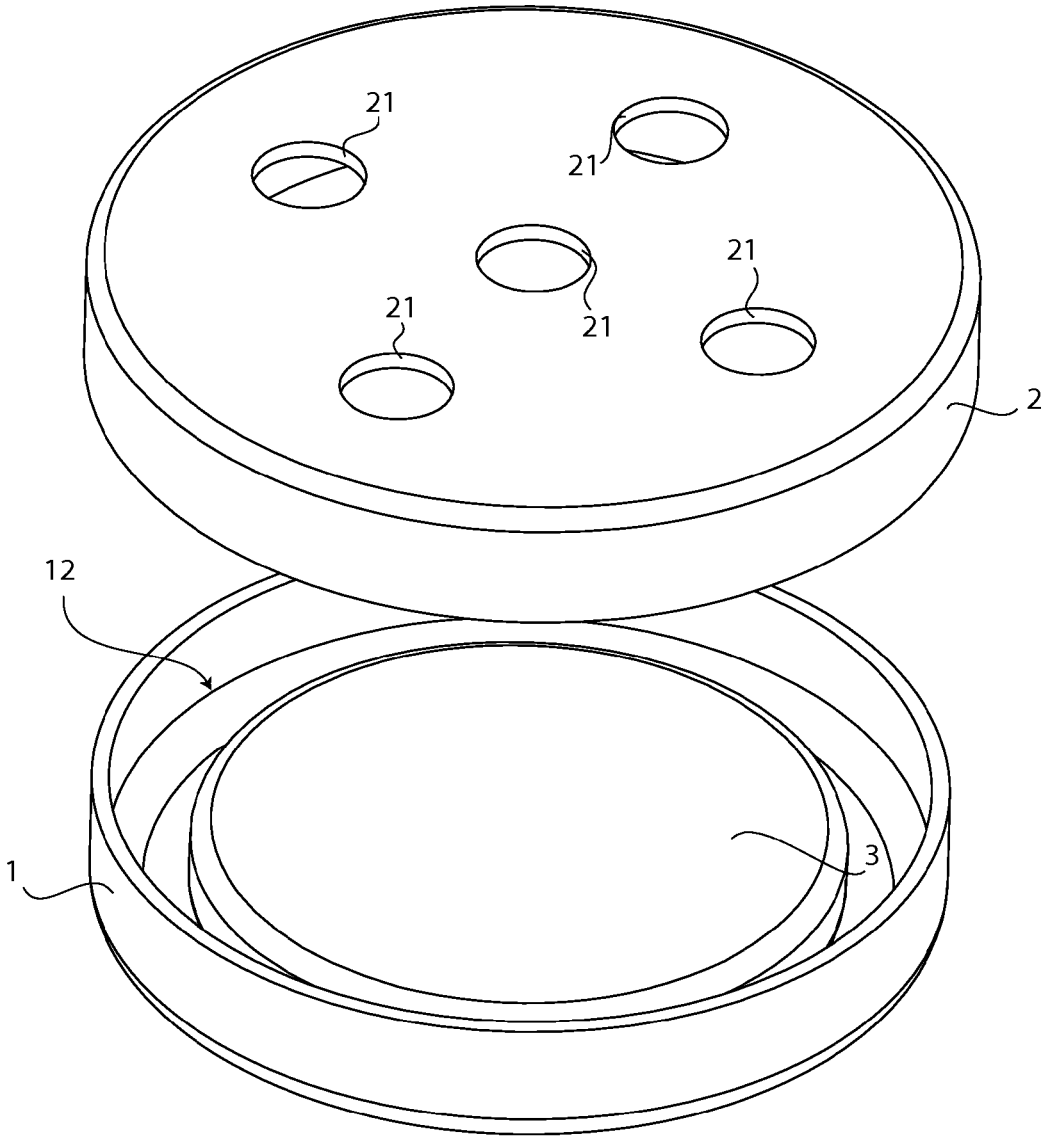
FIG. 2 is an exploded view of the present invention.

The present invention is an underwater Frisbee golf disc locator device that can be attached to the underside of a Frisbee disc to indicate its position when submerged under water. The present invention comprises a base 1, a cap 2, and an effervescent tablet 3. In reference to FIG. 1-3, the base 1 and the cap 2 together form the body of the present invention. The base 1 further comprises an adhesive 11 and a compartment 12. The cap 2 further comprises a plurality of holes 21 and a base slot 22. The base 1 is shallow disc shaped component with the compartment 12. The compartment 12 is a recessed space on a first side of the base 1. The compartment 12 provides the space for the effervescent tablet to be placed and stored. In the preferred embodiment of the present invention, the base 1 and the cover are made from light weight polymer materials. The light weight of the base 1 and the cap 2 ensures that the present invention does not affect the performance and flight path of the Frisbee golf disc when thrown. However, other embodiment of the present invention, the base 1 and the cap 2 can be made from other suitable light weight materials. The adhesive 11 is adhered to the base 1 on a second side of the base 1 opposite from the compartment 12. The adhesive 11 provides the present invention with the ability to attach to the underside of a Frisbee golf disc. In the preferred embodiment of the present invention, the adhesive 11 is made from a water resistant material that is able to have a strong bond to the Frisbee golf disc. The adhesive 11 plays an important role for the present invention to ensure the device remains on the Frisbee golf disc as impact is made with a ground surface or water surface. If the strength of the adhesive 11 is not enough, the present invention may detach from the Frisbee golf disc. As a result, if the Frisbee golf disc lands into a water hazard, the absence or displacement of the present invention will fail to help the user find their disc.

Figure 3:
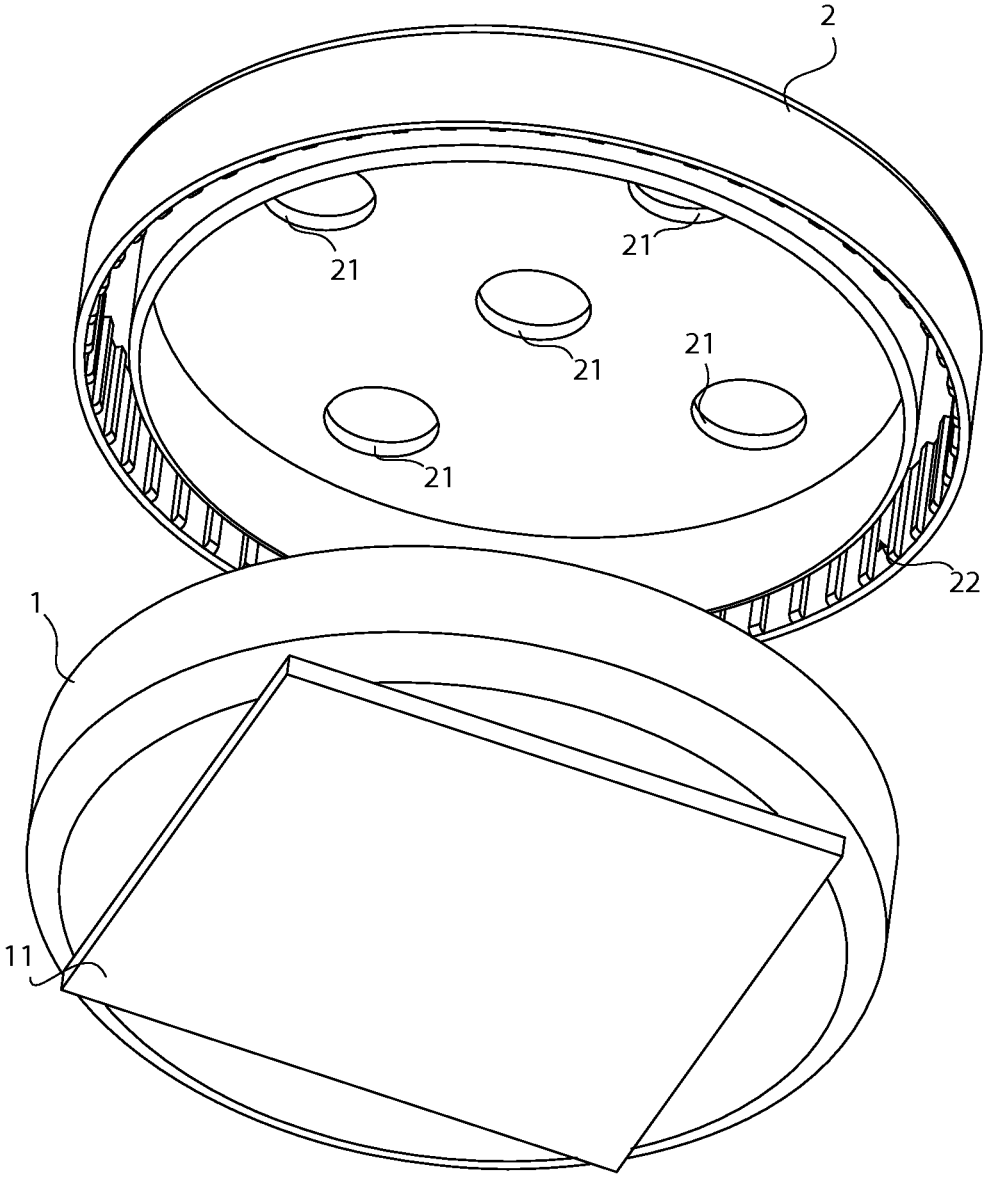
FIG. 3 is an exploded view of the present invention showing the bottom side of the base and the cap.

In reference to FIG. 3, the cover of the present invention is able to engage to the base 1 by means of the base slot 22. The base slot 22 is a downward extending slot on that cap 2 that is able to fit the walls of the base 1. The base slot 22 is positioned peripherally on the cap 2. With the effervescent tablets 3 being stored within the compartment 12 of the base 1 and being sealed by the cap 2, the cap 2 comprises of the plurality of holes 21 to allow the effervescent tablets 3 to indicate the position of the present invention. The plurality of holes 21 are evenly dispersed and traverse through the cap 2. The plurality of holes 21 are sized to be smaller than the effervescent tablets 3 to ensure the effervescent tablets 3 remain within the compartment 12. When the device is submerged under water, water is able to enter the compartment 12 and contact the effervescent tablets 3 through the plurality of holes 21. The effervescent tablets 3 react from the water and produce bubbles. As a result, the bubbles exit the plurality of holes 21 and travel to the water surface to indicate the device's position. In the preferred embodiment of the present invention, the effervescent tablet is a sodium bicarbonate tablet. In other embodiments of the present invention the effervescent tablet can be any other suitable tablets that are able to produced bubbles as a reaction with water. The present invention is designed to allow the release of bubbles for approximately one minute if the Frisbee golf disc lands upside down into the water. When the Frisbee golf disc lands right side up, the present invention will release one large bubble to the surface every 45 to 50 seconds for a total time up to 4 minutes.

In other embodiment of the present invention, the base 1 and the cap 2 can be shaped into squares, ovals, or any other suitable shape. However, it is preferred that the shape of the present invention be circular due to its evenly distributed mass. An evenly distributed mass is important to prevent negative effect on the Frisbee golf disc's flight performance. In addition to evenly distributed mass, it is preferred that the present invention be placed on the center of the underside of the Frisbee golf disc.

The present invention will be manufactured to be ready to use. To use the present invention, the user would peel apply the adhesive 11 to the bottom of the base 1 to bottom center of the Frisbee golf disc. The cap 2 can be removed to access the compartment 12 for the placement of effervescent tablets 3. Once the tablets are in place the cap 2 is replaced and the Frisbee golf disc can be used normally. When the Frisbee golf disc enters the water, the user will be able to locate and retrieve it. Once retrieved, the user can simply place another effervescent tablet into the compartment 12.

In another embodiment of the present invention, the base 1 can be directly manufactured as one piece with the Frisbee disc. The base 1 will be extended form the bottom center of the disc and be sealed by mean of the cap 2 with the same means.

Although the invention has been explained in relation to its preferred embodiment, it is to be understood that many other possible modifications and variations can be made without departing from the spirit and scope of the invention as hereinafter claimed.

What is claimed is:

1. An underwater frisbee golf disc locator comprises,
a base;
a cap;
a effervescent tablet;
the base comprises a adhesive and a compartment;
the cap comprises a plurality of holes and a base slot;
the cap being engaged to the base; and
the effervescent tablet being positioned in the compartment.

2. The underwater frisbee golf disc locator as claimed in claim 1 comprises,
the compartment being a recessed space on the base; and
the adhesive being adhered to the base opposite of the compartment.

3. The underwater frisbee golf disc locator as claimed in claim 1 comprises,
the base slot being downwardly extended from the cap;
the base slot being positioned peripherally on the cap; and
the plurality of holes being evenly dispersed on and traversed through the cap.

4. An underwater frisbee golf disc locator comprises,
a base;
a cap;
a effervescent tablet;
the base comprises a adhesive and a compartment;
the cap comprises a plurality of holes and a base slot;
the cap being engaged to the base;
the effervescent tablet being positioned in the compartment;
the compartment being a recessed space on the base; and
the adhesive being adhered to the base opposite of the compartment.

5. The underwater frisbee golf disc locator as claimed in claim 4 comprises,
the base slot being downwardly extended from the cap;
the base slot being positioned peripherally on the cap; and
the plurality of holes being evenly dispersed on and traversed through the cap.

6. An underwater frisbee golf disc locator comprises,
a base;
a cap;
a effervescent tablet;
the base comprises a adhesive and a compartment;
the cap comprises a plurality of holes and a base slot;
the cap being engaged to the base;
the effervescent tablet being positioned in the compartment;
the compartment being a recessed space on the base;
the adhesive being adhered to the base opposite of the compartment;
the base slot being downwardly extended from the cap;
the base slot being positioned peripherally on the cap; and
the plurality of holes being evenly dispersed on and traversed through the cap.

* * * * *